US011486178B2

(12) United States Patent
Jeffries et al.

(10) Patent No.: US 11,486,178 B2
(45) Date of Patent: Nov. 1, 2022

(54) SLIDING CLOSURE FOR CABINETS

(71) Applicant: Austin Hardware & Supply, Inc., Lee's Summit, MO (US)

(72) Inventors: Mark Steven Jeffries, Buford, GA (US); Jason Ross Jeffries, Buford, GA (US)

(73) Assignee: Austin Hardware & Supply Inc., Lee's Summit, MO (US)

( * ) Notice: Subject to any disclaimer, the term of this patent is extended or adjusted under 35 U.S.C. 154(b) by 0 days.

(21) Appl. No.: 15/699,340

(22) Filed: Sep. 8, 2017

(65) Prior Publication Data

US 2018/0073290 A1 Mar. 15, 2018

Related U.S. Application Data

(60) Provisional application No. 62/393,368, filed on Sep. 12, 2016.

(51) Int. Cl.

| | |
|---|---|
| ***E05D 15/06*** | (2006.01) |
| ***E05B 17/00*** | (2006.01) |
| ***E05B 65/08*** | (2006.01) |
| ***E05D 15/08*** | (2006.01) |
| ***E05C 3/14*** | (2006.01) |
| ***E05C 19/00*** | (2006.01) |

(52) U.S. Cl.

CPC ..... *E05D 15/0682* (2013.01); *E05B 17/0008* (2013.01); *E05B 65/0835* (2013.01); *E05C 3/14* (2013.01); *E05C 19/002* (2013.01); *E05D 15/08* (2013.01); *E05Y 2900/20* (2013.01)

(58) Field of Classification Search

CPC . E05D 15/0682; E05D 15/0686; E05D 15/08; Y10T 292/0926; Y10T 292/0928; Y10T 292/0934; E05C 3/14; E05C 19/12

See application file for complete search history.

(56) References Cited

U.S. PATENT DOCUMENTS 2,749,164 A * 6/1956 Kitzelman ..... E05B 65/0811 292/121
2,862,378 A * 12/1958 Harris ..... E05B 65/0817 70/95
3,050,322 A * 8/1962 Miller ..... E05B 65/08 292/114

(Continued)

OTHER PUBLICATIONS

CA 2978813 Office Action dated Aug. 20, 2019 (3 pages).
CA 2978813 Office Action dated Jun. 9, 2020 (5 pages).

*Primary Examiner* — Gregory J Strimbu
(74) *Attorney, Agent, or Firm* — Polsinelli PC

(57) ABSTRACT

A frame includes sliding panels to cover an opening of a cabinet. The panels are mounted to interlocking stiffeners. Each of the interlocking stiffeners includes a base portion that forms a channel to receive a forward leading edge or a rear leading edge of the panels. The interlocking stiffeners share forces between the panels. A latch assembly may also be engaged to the interlocking stiffener attached to the forward leading edge of the panel. The latch assembly includes a protruding or projecting portion, such as a bull-nose, that positions the latch assembly with respect to a side frame member. During a closing operation, the protruding portion enters a channel of the side frame member. The protruding portion engages with the channel of the side frame member, which results in proper alignment for the latch assembly.

22 Claims, 4 Drawing Sheets

(56) References Cited

U.S. PATENT DOCUMENTS

| | | | | | |
|---|---|---|---|---|---|
| 3,161,923 | A * | 12/1964 | Crain | E05B 65/0835 | 292/128 |
| 3,808,742 | A * | 5/1974 | Ehret | B60J 1/16 | 49/413 |
| 3,893,261 | A * | 7/1975 | Cribben | E05B 65/0835 | 49/449 |
| 4,114,934 | A * | 9/1978 | Kelly | E06B 3/4681 | 16/443 |
| 4,395,847 | A * | 8/1983 | Atchison | E06B 3/42 | 292/DIG. 46 |
| 4,461,500 | A * | 7/1984 | van der Horst | E05B 65/0835 | 292/106 |
| 2010/0242365 | A1* | 9/2010 | Langner | E05D 15/0686 | 49/130 |

* cited by examiner

SLIDING CLOSURE FOR CABINETS

CROSS REFERENCE TO RELATED APPLICATION

This application claims the benefit of U.S. Provisional Patent Application 62/393,368 filed Sep. 12, 2016, which is hereby incorporated by reference.

FIELD OF INVENTION

The present invention relates to sliding closures for cabinets.

SUMMARY

Frames are used to cover a front of a cabinet and to selectively open and close the cabinet. The frames may include sliding closures or panels to cover an opening of the cabinet. The frames may further include a hinged door to cover the opening of the cabinet. The frames may further include a combination hinged door with sliding closures or panels to cover the opening of the cabinet—commonly called a restocking closure. The cabinet and frame described herein are well suited for use on emergency vehicles, such as ambulance, fire trucks, etc. The cabinets and frame may be used for storage on such vehicles. The frames with sliding closures or panels and/or hinged doors may be used close the cabinets and prevent the contents of the cabinet from falling out of the cabinet.

The cabinets may further include the frame with the restocking closure, which includes the hinged door with built-in sliding closures. This allows for the cabinet to be completely opened for restocking the cabinet, and also allows the cabinet to be accessed by sliding the closures, such as Plexiglas panels, to an open position for immediately retrieve items from the cabinet.

In one aspect, sliding closures for cabinets are described. The sliding closures include panels mounted to interlocking stiffeners. The interlocking stiffeners include a base portion that forms a channel to receive a leading edge of the panel. The interlocking stiffeners may be positioned on a forward leading edge, a rear leading edge, or both the forward and read leading edges of the panel. The interlocking stiffeners share forces across an adjacent panel and stiffener. The channel may be lined with teeth or other protrusions that bite into a surface of the panel. In alternative embodiments, the base portion may be affixed to the leading edge via screws, fasteners, epoxies, adhesives etc. The interlocking stiffeners include extending members that extend sideways relative to a vertical height of the panels. The extending members may extend in a generally perpendicular direction to the channel. The extending members may include support members that extend in a generally perpendicular direction with respect to the extending members. The extending members and/or the support members transfer forces to the adjacent panel. When a force is applied to one of the panels, that panel may bow slightly causing the extending members on that panel to contact the adjacent panel or contact the adjacent extending member and share or transfer the load or force. This provides a stronger design—with the panels being able to withstand greater forces.

The interlocking stiffeners share and transfer forces between an innermost and an outermost panel. For example, if the outermost panel is pushed outward, a rear-most extending member of that stiffener contacts a front-most extending member of the innermost panel. If the innermost panel is pushed outward, an outside surface of that panel's extending member contacts an inside face of the outermost panel. The contact transfers the load between the panels. For example, if the outermost panel is pushed inward, the rear-most extending member of that stiffener contacts an outer surface of the innermost panel. If the innermost panel is pushed inward, an inside surface of that panel's extending member contacts an inside surface of the extending member of the outermost panel.

In another aspect, a frame may hold a first panel and a second panel in a sliding engagement. The first panel may slide in front of the second panel and/or the second panel may slide behind the first panel. The first panel and second panel are mounted to panel supports. The panel supports allow the panels to be easily removed from the frame. The panel supports may include a spring structure that removably engages to bottom edges of the sliding panels. The panel supports slide relative to a bottom surface of a channel of the frame. The panel supports support the panel. As such, the panel supports elevate the bottom edge of the panels relative to the bottom surface of the channel. Depending on the size of the panel, one, two, or more panel supports may be engaged to the bottom edge of each panel.

The panel supports allow the panels to be easily removed from the frame. The panel supports may be disengaged from the bottom edge of the panel by depressing the spring structure. This allows the panel supports to be moved laterally with respect to the channel of the frame—and off of the bottom edge of the panel and at each respective corner. Now, the bottom edge of the panel has no support and may be moved downward to rest directly on the bottom surface of the channel. This in turn moves a top edge of the panel downward in an upper channel which disengages the top edge with the panel supports in the upper channel and allows that top edge to be positioned below the confines of the upper channel. From this unrestrained position, the panel may be tilted forward and removed from the frame. This removability is especially useful when a panel has become scratched, damaged, etc.

The panel supports may be provided in different lengths to support different length panels. The panel supports may comprise a single piece or multiple pieces to allow the length variation.

In another aspect, a latch assembly may be engaged to a forward edge of the panel. The latch assembly includes a channel to receive the forward edge. The latch assembly includes a protruding or projecting portion, such as a bull-nose, that positions the latch assembly. During a closing operation, the protruding portion enters a channel of a side frame member. The protruding portion engages with the channel of the side frame member, which results in proper alignment for the latch assembly. The latch may include a striker and pawl assembly having a negative angle that resists opening forces.

In another aspect, a frame assembly with sliding panels is described. The frame assembly includes a frame having an upper section opposite of a lower section and a left section opposite of a right section. The lower section of the frame defines a first channel and a second channel. A first sliding panel includes a first lower edge and a rear edge. The first lower edge slides in the first channel. A second sliding panel includes a second lower edge and a forward edge. The second lower edge slides in the second channel. A first interlocking stiffener is engaged to the rear edge of the first panel. A second interlocking stiffener is engaged to the forward edge of the second panel. The first interlocking stiffener transfers forces to the second panel and to the second interlocking stiffener. The second interlocking stiffener transfers forces to the first panel and to the first interlocking stiffener.

In another aspect, both a first, outer panel and a second, inner panel include interlocking stiffeners that include extending members that transition into support members. The support member of the first, outer panel is configured to enter into a first space formed between the support member of the second, inner panel and a front surface of the second, inner panel. The support member of the second, inner panel is configured to enter into a second space formed between the support member of the first, outer panel and a rear surface of the first, outer panel. When the first, outer panel is pushed from the inside, an inner surface of the support member on a back of the first, outer panel moves forward to contact an inner surface of the support member of the stiffener of the second, inner panel. The load distributes through the stiffeners that have come into contact. When the force is applied from the inside to the second, inner panel, then the stiffener of the second, inner panel is urged to move outward and the outer surface of that support member directly contacts the rear surface of the first, outer panel. This contact then transmits and distributes the forces to the stiffener of the first, outer panel.

In another aspect, a frame assembly with sliding panels is described. The frame assembly includes a frame including an upper section opposite of a lower section and a left section opposite of a right section. The lower section of the frame defines a first channel and a second channel. A first sliding panel includes a first lower edge. One or more panel supports are removably engaged to the first lower edge. The one or more panel supports slide in the first channel. A second sliding panel includes a second lower edge. One or more panel supports are removably engaged to the second lower edge. The one or more panel supports slide in the second channel.

In another aspect, a frame assembly with sliding panels is described. The frame assembly includes a frame including an upper section opposite of a lower section and a left section opposite of a right section. The lower section of the frame defines a first channel and a second channel. A first sliding panel includes a first lower edge. The first lower edge slides in the first channel. A second sliding panel including a second lower edge. The second lower edge slides in the second channel. A latch is engaged to a forward edge of the first sliding panel. The latch includes a channel to receive the forward edge. A striker is integrated into the left or right frame section.

In another aspect, a method of replacing sliding panels in a frame is described. The method includes providing a frame including an upper section opposite of a lower section and a left section opposite of a right section. The lower section of the frame defines a first channel and a second channel. A first sliding panel includes a first lower edge. One or more panel supports are removably engaged to the first lower edge by a spring portion. The one or more panel supports slide in the first channel. A second sliding panel includes a second lower edge. One or more panel supports are removably engaged to the second lower edge by a spring portion. The one or more panel supports slide in the second channel. The method includes depressing the spring portions of the panel supports. The method includes disengaging the panel supports from the first and second panels. The method includes moving the first and second panels laterally and off of the panel supports. The method includes tilting the first and second panels out of the frame.

In another aspect, a method of replacing a sliding panel in a frame is described. The method includes providing a frame having an upper section opposite of a lower section and a left section opposite of a right section. The lower section of the frame defines a channel. A sliding panel includes a lower edge. One or more panel supports are removably engaged to the lower edge by a spring portion. The one or more panel supports slide in the channel, and an overall height of the sliding panel and the panel supports maintain the sliding panel in the frame. The method includes depressing the spring portions of the panel supports. The method includes disengaging the panel supports from the sliding panel. The method includes moving the sliding panel off of the panel supports, wherein the panel has a height which is less than a height of the frame. The method includes removing the sliding panel from the frame.

In another aspect, a method of replacing sliding panels in a frame is described. The method includes providing a frame having an upper section opposite of a lower section and a left section opposite of a right section. The lower section of the frame defines a first channel and a second channel. A first sliding panel includes a first lower edge. One or more panel supports are removably engaged to the first lower edge by a spring portion. The one or more panel supports slide in the first channel. A second sliding panel includes a second lower edge. One or more panel supports are removably engaged to the second lower edge by a spring portion. The one or more panel supports slide in the second channel. The method includes depressing the spring portions of the panel supports. The method includes disengaging the panel supports from the first and second panels. The method includes moving the panel supports laterally until the panel supports are not under the first and second panels. The method includes removing the first and second panels out of the frame.

In another aspect, a method of replacing a sliding panel in a frame is described. The method includes providing a frame having an upper section opposite of a lower section and a left section opposite of a right section. The lower section of the frame defines a channel. A sliding panel includes a lower edge. One or more panel supports are removably engaged to the lower edge by a spring portion. The one or more panel supports slide in the channel, and an overall height of the sliding panel and the panel supports maintains the sliding panel in the frame. The method includes depressing the spring portions of the panel supports. The method includes disengaging the panel supports from the sliding panel. The method includes moving the panel supports laterally until the panel supports are not under the sliding panel. The method includes removing the sliding panel from the frame.

DETAILED DESCRIPTION OF INVENTION

Figure 1:
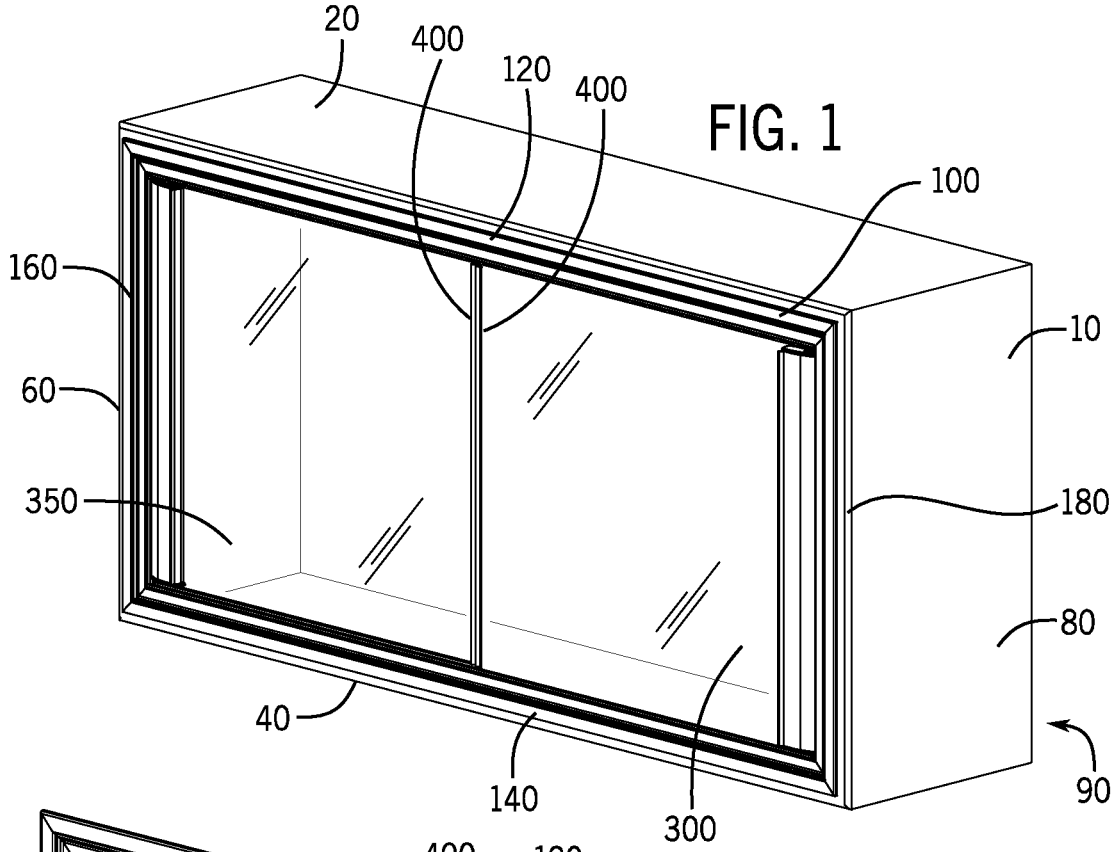
FIG. 1 is a perspective view of the cabinet and frame.
Figure 2:
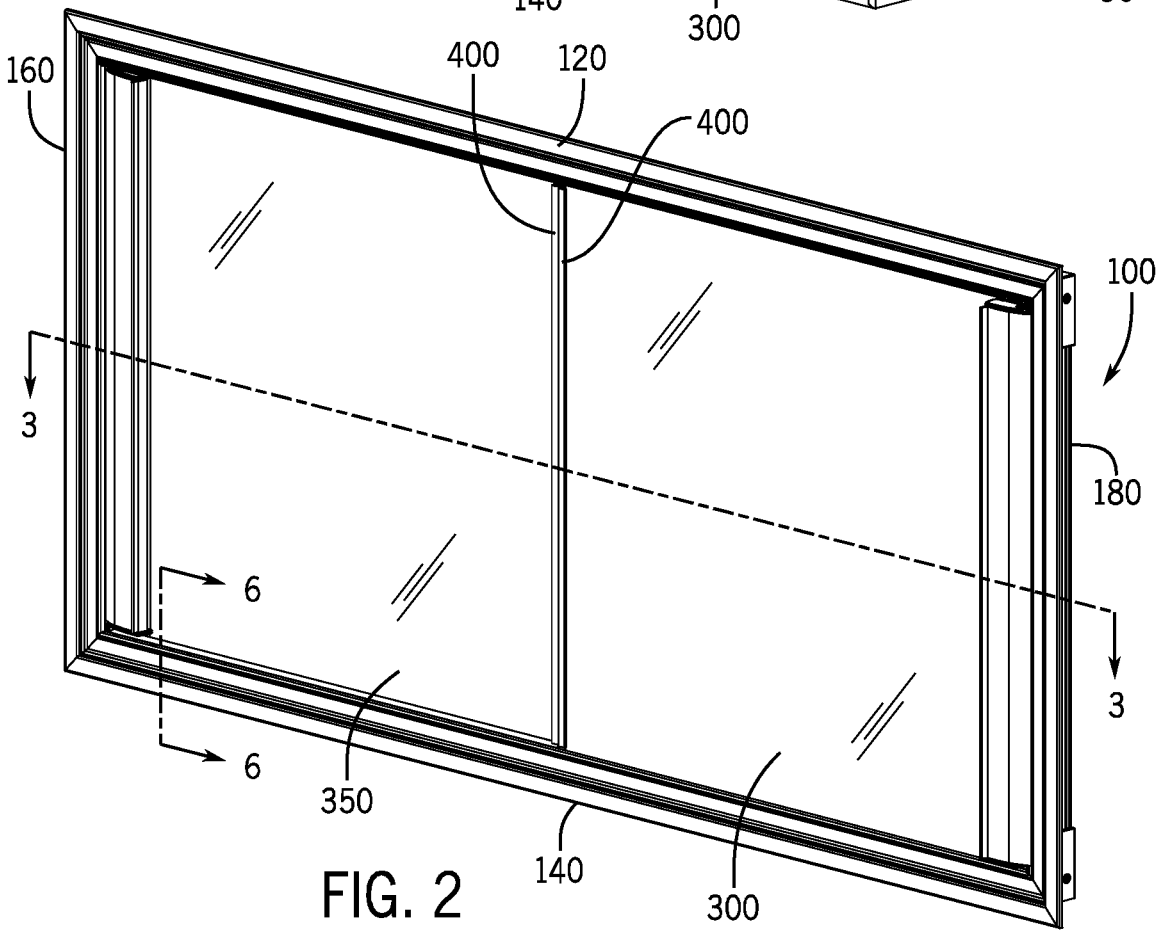
FIG. 2 is a perspective view of the frame.

With reference to FIGS. 1 and 2, a cabinet 10 and a frame 100 are shown. The frame 100 engages to a front of the cabinet 10. The frame 100 may be inserted over an opening of the cabinet 10.

The frame 100 includes an upper frame section 120 opposite of a lower frame section 140 and a left frame section 160 opposite of a right frame section 180.

The cabinet 10 may be formed to have a generally rectangular or square shape. The cabinet includes an upper wall 20 opposite of a lower wall 40 and a left side wall 60 opposite of a right side wall 80. The walls 20, 40, 60, and 80 generally define the opening for the cabinet 10. The walls 20, 40, 60, and 80 may be fastened together with or without a rear wall 90.

Figure 6:
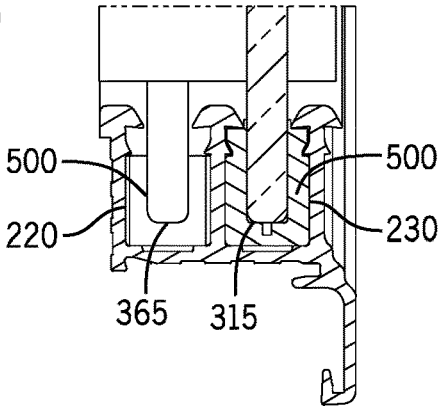
FIG. 6 is a sectional view of the frame holding the panel.
Figure 7A:
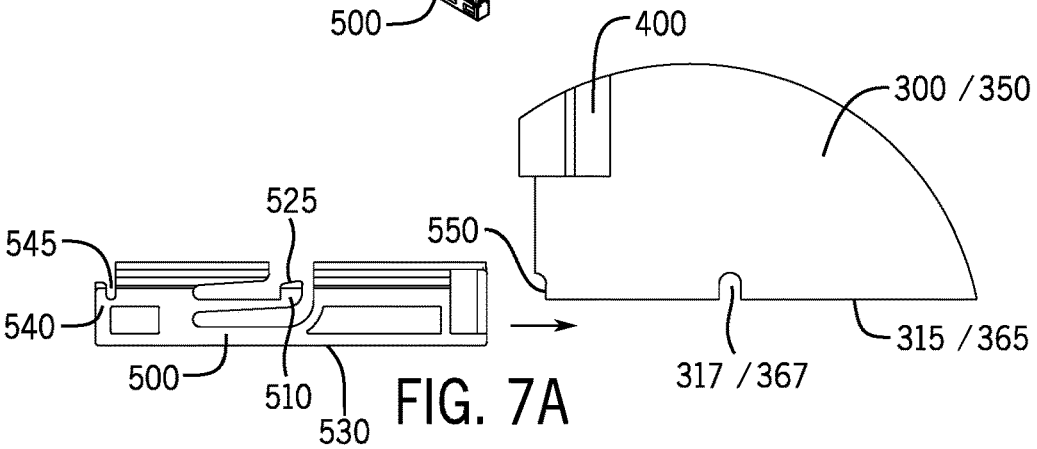
FIG. 7A is a view of the panel support before engagement to the panel.
Figure 7B:
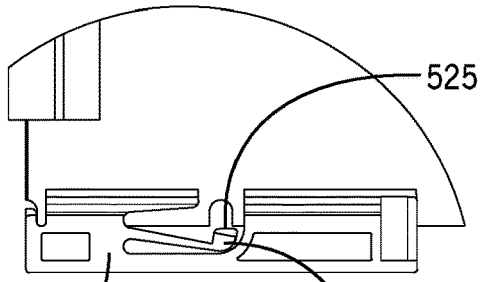
FIG. 7B is a view of the panel support with its spring depressed.
Figure 7C:
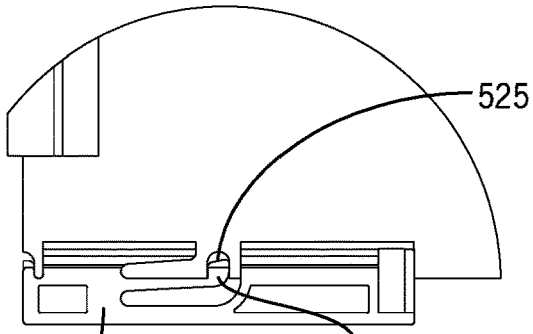
FIG. 7C is a view of the panel support engaged to the panel.
Figure 8:
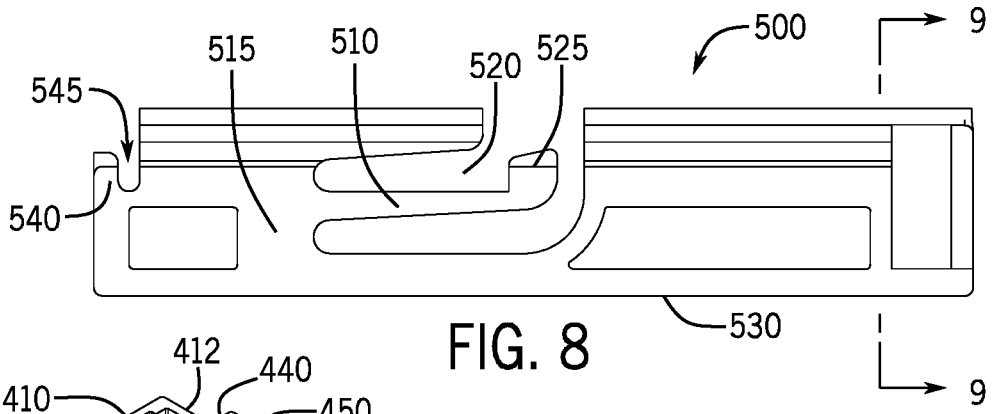
FIG. 8. is a front view of the panel support.
Figure 11:
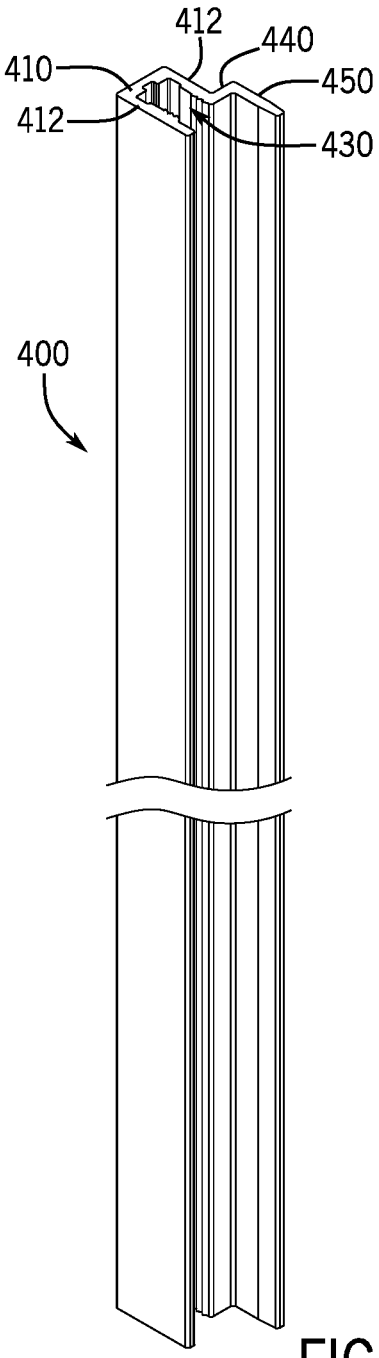
FIG. 11 is a perspective of the interlocking stiffener.
Figure 9:
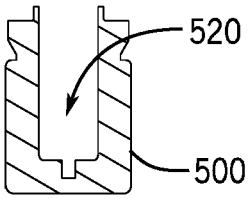
FIG. 9 is a sectional view of the panel support.

The lower frame section 140 and the upper frame section 120 of the frame may 100 hold a first panel 300 and a second panel 350 in a sliding engagement. With reference to FIG. 6, the first panel 300 and the second panel 350 are slidably mounted to the lower frame section 140 and the upper frame section 120. Both the lower frame section 140 and the upper frame section 120 include channels that receive the first panel 300 and the second panel 350 in the sliding engagement.

In this aspect, the first panel 300 forms an outer panel, and the second panel 350 forms an inner panel. Depending on the user preference, the first panel 300 may slide in front of the second panel 350 and/or the second panel 350 may slide behind the first panel 300. The panels 300 and 350 may be formed from a variety of sheet-like materials, such as Plexiglass, polycarbonate, other plastics, metals, woods, composites, etc. The first panel 300 includes a forward leading edge 305, a rear leading edge 310, a bottom edge 315, and a top edge 320. The first panel 300 includes a front surface 325 and a rear surface 330. The forward leading edge 305 and the rear leading edge 310 may be generally perpendicular to the bottom edge 315 and the top edge 320. Similarly, the second panel 350 includes a forward leading edge 355, a rear leading edge 360, a bottom edge 365, and a top edge 370. The forward leading edge 355 and the rear leading edge 360 may be generally perpendicular to the bottom edge 365 and the top edge 370. The second panel 350 includes a front surface 375 and a rear surface 380. Although the frame 100 is shown with the two panels 300 and 350, the frame 100 may include additional panels. For example, the frame 100 may include three sliding panels.

An interlocking stiffener 400 is shown in FIGS. 3, 4, 11, and 12. The interlocking stiffener 400 includes a base portion 410 that forms a channel 430 to receive a leading edge of one of the panels 300 or 350. Sidewalls 412 define the channel 430. In the aspect show, two sidewalls 412 are on opposite sides of the channel 430. The interlocking stiffeners 400 may be positioned on the forward leading edges 305, 355, rear leading edges 310, 360, or both the forward and read leading edges 305, 355, 310, 360 of the panels 300 or 350. The interlocking stiffeners 400 shares forces across the adjacent panel 300 or 350 and stiffener 400. The interlocking stiffeners 400 on the adjacent panel 300 or 350 interlock with each other when the panels 300 and 350 are moved to a closed position.

The sidewalls 412 of the interlocking stiffeners 400 secure to the panel 300 or 350. The sidewalls 412 of the interlocking stiffeners 400 may be lined with teeth or other protrusions that bite into a surface of the panel 300 or 350. In alternative embodiments, the base portion 410 or sidewalls 412 may be affixed to the leading edge via screws, fasteners, epoxies, adhesives etc.

The interlocking stiffeners 400 include extending members 440 that extend sideways relative to a vertical height of the panels 300 or 350. The sidewall 412 transitions into the extending member 440, for example, the extending member 440 may be integral to the sidewall 412. The extending member 440 may extend generally perpendicular to the channel 430. The extending member 440 may include a support member 450 that extends in a generally perpendicular direction with respect to the extending member 440. As such, the support member 450 may be generally parallel to the extending member 440. The extending member 440 may transition into the support member 450, for example, the extending member 440 may be integral to the support member 450. Either one of the sidewalls 412 may include the extending member 440 and the support member 450. In other aspects, both of the sidewalls 412 include the extending member 440 and the support member 450.

Figure 3:
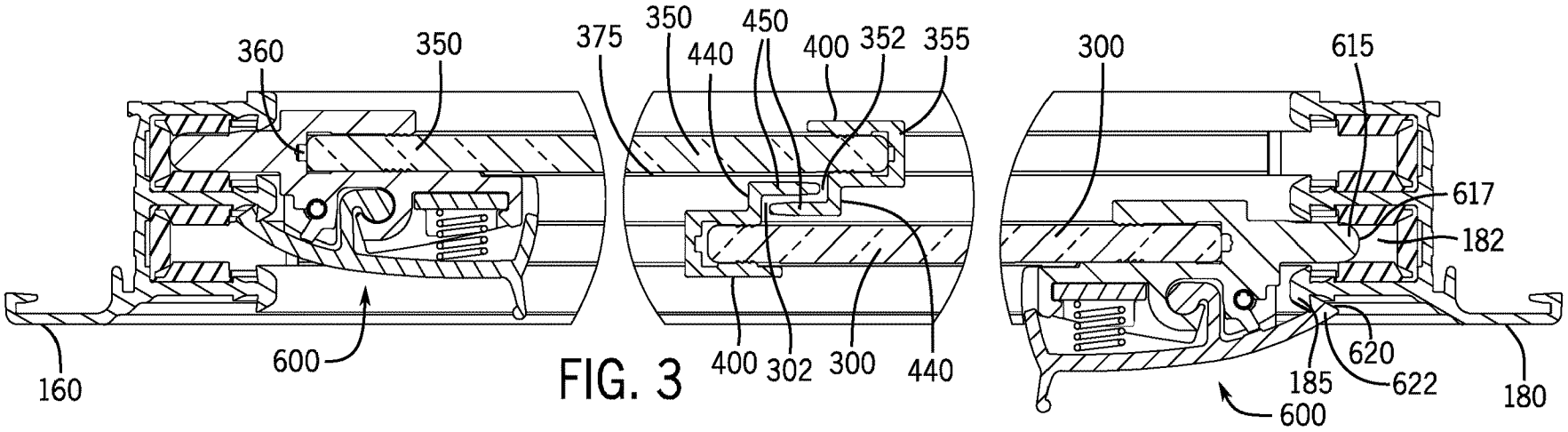
FIG. 3 is a sectional view of the frame.

The extending members 440 and/or the support members 450 may transfer forces to the adjacent panel 300 or 350 during, for example, a collision or other impact. When a force is applied to one of the panels 300 or 350, the panel 300 or 350 may bow slightly causing the extending member 440 and/or the support members 450 to contact the adjacent panel 300 or 350 and share or transfer the load or force. Similarly, when a force is applied to one of the panels 300 or 350, the panel 300 or 350 may bow slightly causing the surface of the panel 300 or 350 to contact the extending members 440 and/or the support members 450 of the adjacent panels 300. This provides a stronger design—with the panels 300 or 350 being able to withstand greater forces. FIG. 3 show two interlocking stiffeners 400 in a closed position where the support member 450 of the panel 300 is between the second panel 350 and the support member 450 of the panel 350, and the support member 450 of the panel 350 is between the first panel 300 and the support member 450 of the first panel 300. When a force is applied to the first panel 300, the support member 450 of the first panel 300 contacts the second panel 350 and the support member 450 of the second panel 350 contacts the first panel 300. In the closed position, the adjacent interlocking stiffeners 400 interlock with each other to increase the durability of the cabinet 10.

Figure 12:
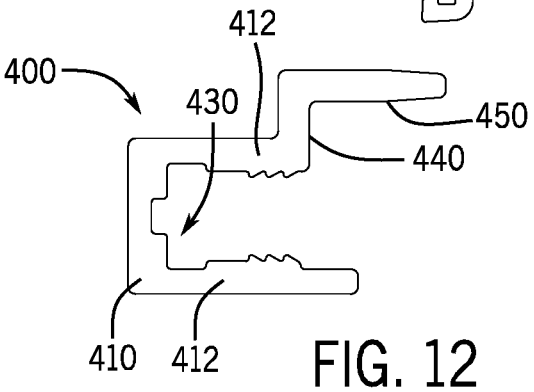
FIG. 12 is an end view of the interlocking stiffener.

The interlocking stiffeners 400 may be formed from an extruded metal, such as aluminum or other metal. For example, the aluminum may be melted and forced through a die resulting in lengths of an extrusion having an end view as shown in FIG. 12. The interlocking stiffeners 400 may be cut to length from the lengths of extrusion.

Figure 10:
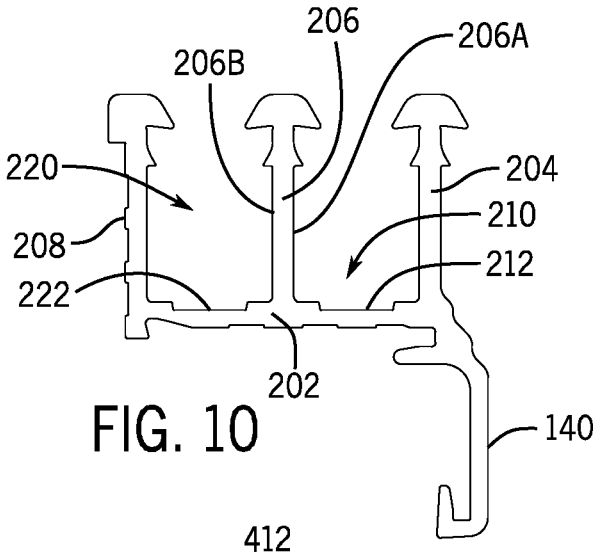
FIG. 10 is an end view of the frame.

With reference to FIGS. 6 and 10, the first panel 300 is slidably mounted in a first channel 210 of the lower frame section 140, and the second panel 350 is slidably mounted in a second channel 220 of the lower frame section 140. The upper frame section 120 includes corresponding channels to hold the top edges 320, 370. The upper frame section 120 may have a substantially similar or identical profile as the lower frame section 140. With reference to FIG. 10, an end view of the lower frame section 140 is shown. The lower frame section 140 includes a central wall 202. The lower frame section 140 includes an outer wall 204, a center wall 206, and an inner wall 208, which all extend generally perpendicular to the central wall 202. The lower frame section 140 and the other frame sections 120, 160, 180 may be formed using extruded metal alloys. For example, aluminum may be melted and forced through a die resulting in lengths of material having an end view as shown in FIG. 10.

The frame section 140 includes the first channel 210 with a first bottom surface 212. The frame section 140 includes the second channel 220 with a second bottom surface 222. The first channel 210 and the second channel 220 are in a parallel arrangement. The first channel 210 and the second channel 220 share the center wall 206 with a lateral side 206A of the center wall 206 forming one of the walls of the first channel 210 and another lateral side 206B of the center wall 206 forming one of the walls of the second channel 220. The upper frame section 120, the left frame section 160, and the right frame section 180 may be formed from the same lengths of extruded materials and thus have an identical cross-section to the lower frame section 140. The first channel 210 and the second channel 220 may extend a length of the frame section 140.

In the closed position, the adjacent interlocking stiffeners 400 interlock with each other to increase the durability of the cabinet 10. The panels 300 and 350 slide toward each other to interlock the stiffeners 400. As shown in FIG. 3, the panels 300 and 350 are in a closed position and the stiffener 400 on the panel 300 is locked with the stiffener 400 on the panel 350. The support member 450 of the panel 300 is in a space 352 formed between the support member 450 of the second panel 350 and the front surface 375 of the second panel 350. Likewise, the support member 450 of the second panel 350 is in a space 302 between the support member 450 of the first panel 300 and the rear surface 330 of the first panel 300. When an inward force is applied to the first panel 300, the support member 450 of the first panel 300 contacts the second panel 350 and the support member 450 of the second panel 350 contacts the first panel 300. When an outward force is applied to the second panel 350, the support member 450 of the second panel 350 contacts the first panel 300 and the support member 450 of the first panel 300 contacts the second panel 350.

With reference to FIGS. 7A-7C, 8 and 9, a panel support 500 is shown. The panel supports 500 support the panels 300, 350 in the lower frame section 140. The panel supports 500 may also be engaged to the top edges 320, 370 to assist in holding the top edges 320 and 370 in the upper frame section 120. The panel supports 500 removably attach or engage to the panels 300, 350. The panel supports 500 slide relative to the bottom surfaces 212, 222 of the channels 210, 220 of the lower frame section 140 as the panels 300, 350 are moved in lateral directions. The panel supports 500 also act as a spacer to raise the panels 300, 350 from the lower frame section 140.

In the aspect shown, the panel support 500 includes a spring portion 510 extending upward from a body 515 of the panel support 500. The panel support 500 includes a central channel 520 that receives the bottom edge 315 of the first panel 300 or the bottom edge 365 of the second panel 350. The spring portion 510 includes a tab 525 that engages with a notch 317 in the bottom edge 315 of the panel 300 or a notch 367 in the bottom edge 365 of the second panel 350. In order to disengage the tab 525 from the notches 317 or 367, the user presses down on the spring portion 510 thus removing the tab 525 from the notches 317, 367 and releasing the bottom edges 315, 365 from the panel supports 500. The spring portion 510 biases upward through the channel 520. For removal of the panel supports 500 engaged to the top edges 320, 370, the spring portion 150 is pushed upwards.

The first panel 300 is mounted on top of two of the panel supports 500. Similarly, the second panel 350 is mounted on top of two of the panel supports 500. In other aspects, fewer or additional panel supports 500 may be employed. Additionally, panel supports 500 may be mounted to the top edges 320, 370. The lower panel supports 500 of the first panel 300 are positioned in the first channel 210 on the first bottom surface 212, while the panel supports 500 of the second panel 350 are positioned in the second channel 220 on the second bottom surface 222. The upper panel supports 500 are positioned in a first channel of the upper frame section 120, while the upper panel supports 500 of the second panel 350 are positioned in a second channel of the upper frame section 120.

The panel supports 500 slide relative to the bottom surfaces 212, 222 of the channels 210, 220 of the frame 100. The bottom surface 530 of the panel supports 500 glides or slides over the bottom surfaces 212 and 222 of the first channel 210 and the second channel 220. The panel supports 500 may be wholly or partially contained in the first channel 210 or the second channel 220.

The panel supports 500 allow the panels 300, 350 to be easily removed from the frame 100. The panel supports 500 include the spring portion 510 that removably engages to bottom edge 315, 365 of the sliding panels 300, 350. The panel supports 500 support the panels 300, 350. As such, the panel supports 500 elevate the bottom edges 315, 365 of the panels 300, 350 relative to the bottom surfaces 212 and 222 of the first channel 210 and the second channel 220. The panel supports 500 add sufficient height to cause the top edges 320, 370 of the panels 300, 350 to lodge in the channels of the upper frame section 120. Depending on the size of the panel 300, 350, one, two, or more panel supports 500 may engaged to the bottom edge 315, 365 of each panel 300, 350 and/or to the top edges 320, 370 of each panel 300, 350.

Once the panel supports 500 are disengaged from the bottom edges 315, 365 of the panels 300, 350, the panels 300, 350 may be moved laterally with respect to the panel supports 500 and then off of the panel supports 500. Or, the panel supports 500 may be disengaged from the bottom edges 315, 365 and then slid relative to the bottom edges 315, 365 until the panel supports 500 are no longer under the bottom edges 315, 365. Now, the panels 300, 350 may rest directly on the bottom surfaces 212, 222 of the channels 210, 220. With the reduced overall height resulting from the disengagement from the panel supports 500, the panels 300, 350 may be tilted forward and removed from the frame 100. This removability is especially useful when a panel 300, 350 has become scratched, damaged, etc. The panel support 500 may be molded from plastic materials with sufficient durability and biasing strength.

An end 540 of the panel support 500 may optionally include an opening 545 that receives a groove portion 550 of either the bottom edge 315 or 365. The insertion of the protruding portion 550 in the opening 545 assists in positioning the panel support 500 along the bottom edges 315 or 365.

Figure 4:
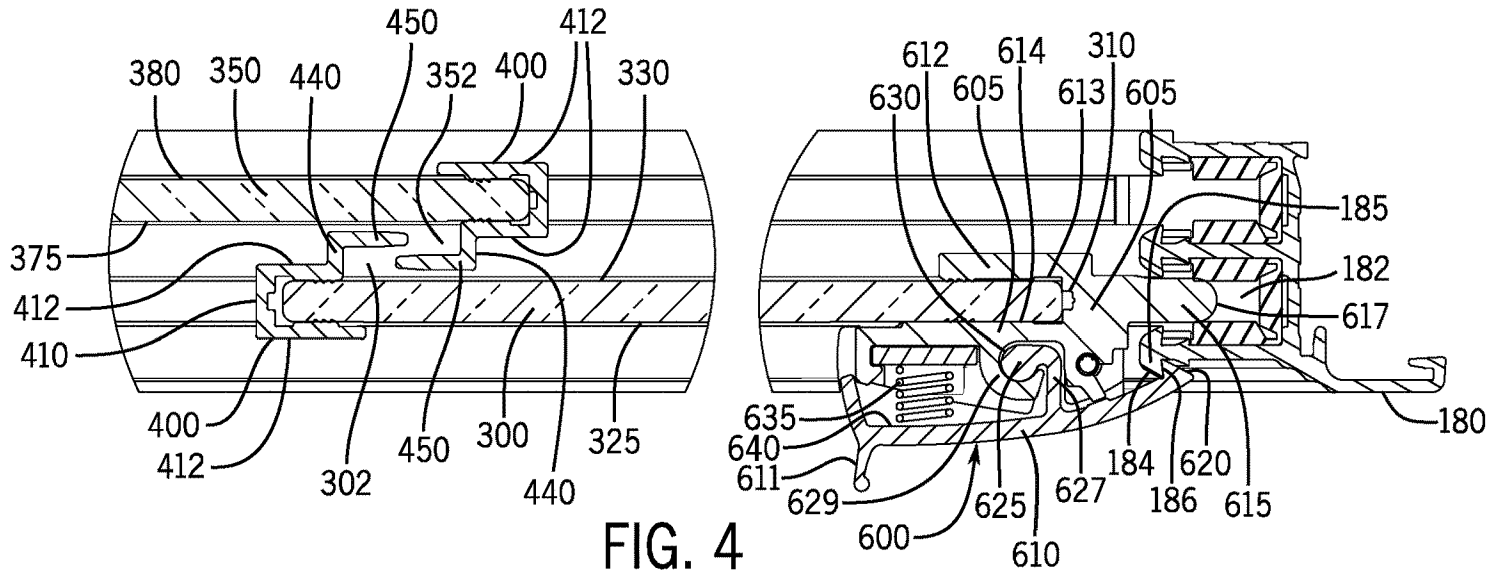
FIG. 4 is a sectional view of the frame.
Figure 5:
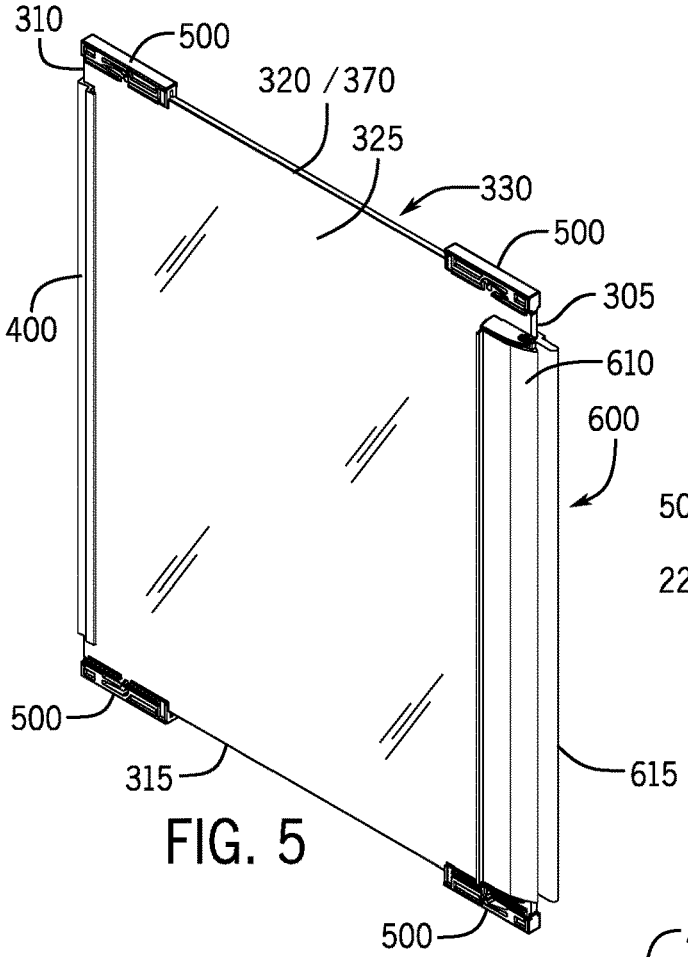
FIG. 5 is a perspective view of the panel.

With reference to FIGS. 3-5, in another aspect, a latch assembly 600 may be engaged to a forward edge or a rear edge of one or both of the panels 300, 350. Typically, each panel 300, 350 will include the latch assembly 600 on the end of the panel 300, 350 opposite of the end with the interlocking stiffeners 400. Of course, depending on the user's preference, only one panel 300, 350 may have the latch assembly 600.

The latch assembly 600 may cover most of the forward edge 305, 355 or rear edge 310, 360 of the panel 300, 350. The latch assembly 600 includes a central body 605 and a pawl member 610 pivotally engaged to the central body 605. The pawl member 610 engages with a striker 185 formed by the left or right frame sections 160, 180. The pawl member 610 and the striker 185 may include interacting locking surfaces with negative angles to provide further locking security. The striker 185 may be an integral feature of the left or right frame sections 160, 180. The striker 185 may be formed during the extrusion process that forms the left or right frame sections 160, 180.

The central body 605 defines a channel 613 to receive the forward leading edge 305 of the first panel 300. The channel 613 is formed by space between an inner wall 612 of the central body 605 and an outer wall 614 of the central body 605. The channel 613 may be lined with teeth or other protrusions that bite into a surface of the forward leading edge 305 of the first panel 300. In alternative embodiments, the central body 605 may be affixed to the forward leading edge 305 via screws, fasteners, epoxies, adhesives etc.

The central body 605 includes a protruding member 615 opposite of the channel 613. The protruding member 615 assists in positioning the latch assembly 600 for proper closure. During a closing operation, the protruding member 615 enters a channel 182 of the right frame section 180. This positions a sloped end 620 of the pawl member 610 at a complementary sloped end 184 of the striker 185 of the right frame section 180. The sloped end 620 moves against the sloped end 184 until a hook portion 622 of the pawl member 610 hooks with an opposing side 186 of the striker 185. The opposing side 186 is opposite of the sloped end 184.

The protruding member 615 assists in properly aligning the pawl member 610 with the striker 185 of the right frame section 180. The protruding member 615 may include one or more ridges or raised surfaces to further aid in alignment. The protruding member 615 may be in the form of a "bull nose" shape, i.e., the protruding member 615 may have a tapered or rounded leading surface 617 to enter into the channel 182 of the right frame section 180.

The pawl member 610 is pivotally engaged to the central body 605 by an axis portion 625 of the pawl member 610 that rotates in an opening 630 of the central body 605. A lever portion 627 connects the axis portion 625 with the remainder of the pawl member 610. The lever portion 627 passes through an opening 629 of the central body 605. The interaction between the lever portion 627 and the opening 629 of the central body 605 limits the range of movement of the pawl member 610. The pawl member 610 further includes a handle portion 611.

The pawl member 610 is normally biased to a closed position by a spring member 635 biased between the central body 605 and an interior surface 640 of the pawl member 610. After the hook portion 622 of the pawl member 610 hooks with the opposing side 186 of the sloped end 184, the biasing force from the spring member 635 helps to maintain the engagement of the hook portion 622 to the opposing side 186.

In the aspect shown, the axis portion 625 is between the handle portion 611 and the hook portion 622. The axis portion 625 rotates in the opening 630 of the central body 605. The opening 630 may be adjacent to the outer wall 614 of the central body 605.

Although the latch assembly 600 is described above with reference to the right frame section 180, the latch assembly 60 may also engage the left frame section 160. The latch assembly 600 may include a striker and pawl assembly having a negative angle that resists opening forces. In the aspect show, there is an approximately 7 degree negative angle between the hook portion 622 and the opposing side 186 of the striker 185. The negative angle strengthens the closing ability of the latch assembly 600. The latch assembly 600 includes the hook portion 622 of the pawl member 610 with a first negative angle forming a first locking surface and the striker 185 includes the opposing side 186 with a second negative angle forming a second locking surface.

As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed is:

1. A frame assembly with a first sliding panel and a second sliding panel, comprising:

a frame comprising an upper section opposite to a lower section and a first side section opposite to a second side section;

the lower section of the frame defining a first channel and a second channel;

the first side section includes a first wall and a second wall, the first and second walls define a side channel;

the first sliding panel comprising a first lower edge, wherein the first lower edge slides in the first channel;

the second sliding panel comprising a second lower edge, wherein the second lower edge slides in the second channel;

a latch engaged with a forward edge of the first sliding panel, the latch includes a central body and a pawl member pivotally engaged with the central body, the central body includes a body channel receiving the forward edge, wherein the central body includes a protruding member forming a leading surface, the protruding member is generally opposite of the body channel, the protruding member includes an entirely tapered or rounded portion, the entirely tapered or rounded portion extends continuously from a first side of the protruding member to a second side of the protruding member, the protruding member configured to enter the side channel of the first side section with the first and second sides of the protruding member configured to simultaneously engage both the first and second walls of the side channel; and a striker attached to the first side section.

2. The frame assembly with a first sliding panel and a second sliding panel according to claim 1, wherein the protruding member positions the latch relative to the first side section when the protruding member enters the first side channel.

3. The frame assembly with a first sliding panel and a second sliding panel according to claim 2, wherein when the protruding member enters the side channel of the first side section, the protruding member is in between the first and second walls of the first side section.

4. The frame assembly with a first sliding panel and a second sliding panel according to claim 1, wherein a first locking surface of the pawl member engages a second locking surface of the striker when the latch is in a locked position to resist opening forces applied to the first sliding panel.

5. The frame assembly with a first sliding panel and a second sliding panel according to claim 1, wherein a first locking surface of the pawl member engages a second locking surface of the striker negative angle of the striker when the latch is in a locked position.

6. The frame assembly with a first sliding panel and a second sliding panel according to claim 1, wherein the latch includes a hook portion that is engageable with a side of the striker.

7. The frame assembly with a first sliding panel and a second sliding panel according to claim 1, wherein the pawl member includes a first locking surface and the striker includes a second locking surface, wherein the protruding member is configured to enter the side channel to align the first locking surface and the second locking surface.

8. The frame assembly with a first sliding panel and a second sliding panel according to claim 1, wherein the protruding member is configured to enter into the side channel of the first side section to position the latch relative to the first side section, wherein the protruding member is a bull-nose.

9. The frame assembly with a first sliding panel and a second sliding panel according to claim 1, wherein the striker is integral to the first side section.

10. The frame assembly with a first sliding panel and a second sliding panel according to claim 1, wherein the first side section is an extrusion, and the striker is an integral portion of the extrusion.

11. The frame assembly with a first sliding panel and a second sliding panel according to claim 1, wherein the central body and the pawl member cover most of the forward edge of the first sliding panel.

12. The frame assembly with a first sliding panel and a second sliding panel according to claim 11, wherein the pawl member incudes a first sloped end, and the striker includes a second sloped end, and the first sloped end is configured to engage the second sloped end when the first sliding panel is moved toward a closed position.

13. The frame assembly with a first sliding panel and a second sliding panel according to claim 11, wherein the pawl member is biased toward a closed position by a spring member.

14. The frame assembly with a first sliding panel and a second sliding panel according to claim 11, wherein the body channel is configured to receive the forward edge of the first sliding panel between an inner wall of the central body and an outer wall of the central body.

15. The frame assembly with a first sliding panel and a second sliding panel according to claim 14, wherein the body channel is lined with teeth.

16. The frame assembly with a first sliding panel and a second sliding panel according to claim 1, wherein the first sliding panel is configured to slide to a closed position, wherein the pawl member includes a first sloped end, and the striker includes a second sloped end, and the first sloped end is configured to engage the second sloped end when the first sliding panel is moved toward the closed position.

17. The frame assembly with a first sliding panel and a second sliding panel according to claim 1, wherein the first sliding panel is configured to slide in the first channel to a closed position, wherein the latch engages with the striker to maintain the first sliding panel in the closed position.

18. The frame assembly with a first sliding panel and a second sliding panel according to claim 17, wherein the second sliding panel is configured to slide in the second channel to a closed position, wherein an additional latch is engaged with a forward edge of the second sliding panel, and the additional latch is engageable with an additional striker of the second side section.

19. The frame assembly with a first sliding panel and a second sliding panel according to claim 18, wherein the first and second sliding panels are configured to open and close an opening of the frame by sliding the first and second sliding panels relative to the frame.

20. The frame assembly with a first sliding panel and a second sliding panel according to claim 1, wherein the protruding member extends farther from the central body than a latching end of the pawl member.

21. A frame assembly with a first sliding panel and a second sliding panel, comprising:

a frame comprising an upper extruded section opposite to a lower extruded section and a first extruded side section opposite to a second extruded side section, and the first extruded side section includes a first wall and a second wall, the first and second walls define a side section channel;

the lower extruded section of the frame defining a first channel and a second channel;

the first sliding panel comprising a first lower edge, wherein the first lower edge slides in the first channel;

the second sliding panel comprising a second lower edge, wherein the second lower edge slides in the second channel;

a striker integral to the first extruded side section; and, a latch engaged with a forward edge of the first sliding panel, the latch includes a central body and a pawl member pivotally engaged with the central body, the central body includes a body channel receiving the forward edge, the central body includes a protruding member forming a leading surface, the protruding member is generally opposite of the body channel, the protruding member includes an entirely tapered or rounded portion, the entirely tapered or rounded portion extends continuously from a first side of the protruding member to a second side of the protruding member, the protruding member is configured to enter the side section channel to align the latch with the striker, wherein when the protruding member enters the side section channel, the protruding member is disposed between the first and second walls of the first extruded side section and the first and second sides of the protruding member simultaneously engage both the first and second walls of the side section channel.

22. A frame assembly with a sliding panel, comprising:

a frame comprising an upper section opposite to a lower section and a first side section opposite to a second side section, and the first side section includes a first wall and a second wall, the first and second walls define a side section channel;

the lower section of the frame defining a lower section channel;

the sliding panel comprising a lower edge, wherein the lower edge is configured to slide in the lower section channel;

a latch engaged with a forward edge of the sliding panel, the latch includes a central body and a pawl member pivotally engaged with the central body, the central body includes a body channel receiving the forward edge, the central body includes a protruding member forming a leading surface, the protruding member is generally opposite of the body channel, the protruding member includes an entirely tapered or rounded portion, the entirely tapered or rounded portion extends continuously from a first side of the protruding member to a second side of the protruding member, the protruding member configured to enter the side section channel;

a striker integral to the first side section; and, the sliding panel is configured to slide in the lower section channel in the lower section of the frame to a closed position, wherein the latch engages with the striker to maintain the sliding panel in the closed position, and wherein when side the protruding member enters the first section channel, the protruding member is in between the first and second walls of the first side section and the first and second sides of the protruding member simultaneously engage both the first and second walls of the side section channel.

* * * * *